US008479881B2

(12) United States Patent
Gordon

(10) Patent No.: US 8,479,881 B2
(45) Date of Patent: Jul. 9, 2013

(54) RESCUE APPARATUS

(76) Inventor: Charmain Gordon, Randolph, MA (US)

( * ) Notice: Subject to any disclaimer, the term of this patent is extended or adjusted under 35 U.S.C. 154(b) by 330 days.

(21) Appl. No.: 12/436,982

(22) Filed: May 7, 2009

(65) Prior Publication Data

US 2009/0277718 A1 Nov. 12, 2009

Related U.S. Application Data

(60) Provisional application No. 61/051,089, filed on May 7, 2008.

(51) Int. Cl.
*A62B 35/00* (2006.01)

(52) U.S. Cl.
USPC ..... 182/3; 182/7; 224/158

(58) Field of Classification Search
USPC ..... 182/3–7, 70; 5/625–628; 297/468; 224/158–161; 383/121.1; 220/9.2
See application file for complete search history.

(56) References Cited

U.S. PATENT DOCUMENTS

| | | | | | |
|---|---|---|---|---|---|
| 219,511 | A | | 9/1879 | Petterson | |
| 241,509 | A | * | 5/1881 | Payne | 182/142 |
| 285,564 | A | | 9/1883 | Brooks | |
| 296,769 | A | * | 4/1884 | Miller | 182/191 |
| 696,931 | A | | 4/1902 | Boettcher | |
| 919,159 | A | * | 4/1909 | Goddard | 5/628 |
| 1,670,709 | A | * | 5/1928 | Blood | 383/33 |
| 1,971,294 | A | * | 8/1934 | Bunker | 5/89.1 |
| 2,030,204 | A | * | 2/1936 | Gray | 220/9.2 |
| 2,616,608 | A | * | 11/1952 | Bellamy | 182/70 |
| 2,680,593 | A | * | 6/1954 | McIntyre | 182/231 |
| 2,899,692 | A | * | 8/1959 | Finken | 5/628 |
| 3,014,516 | A | * | 12/1961 | Mueller | 220/9.2 |
| 3,484,833 | A | * | 12/1969 | Stephen | 297/467 |
| 3,871,480 | A | | 3/1975 | Sauri | |
| 3,944,021 | A | | 3/1976 | Smith, Jr. et al. | |
| 4,056,166 | A | | 11/1977 | Rabelos | |
| 4,088,201 | A | | 5/1978 | MacFarlane | |
| 4,114,726 | A | | 9/1978 | Sentinella | |
| 4,122,917 | A | | 10/1978 | Kendrick | |
| 4,124,908 | A | * | 11/1978 | Burns et al. | 5/628 |
| 4,184,567 | A | | 1/1980 | Rabelos | |
| 4,213,204 | A | | 7/1980 | Donlon et al. | |
| 4,254,900 | A | * | 3/1981 | Wheeler | 224/158 |
| 4,295,543 | A | | 10/1981 | Graham | |
| 4,341,285 | A | | 7/1982 | Krickovich | |
| 4,421,204 | A | | 12/1983 | Lawrence | |
| 4,424,884 | A | | 1/1984 | Smith, Jr. | |
| 4,433,752 | A | | 2/1984 | Gunter | |
| 4,437,546 | A | | 3/1984 | Marinoff et al. | |
| 4,440,261 | A | | 4/1984 | Clark | |
| 4,448,281 | A | | 5/1984 | Adams | |
| 4,487,346 | A | | 12/1984 | Fischer, Jr. | |
| 4,506,760 | A | | 3/1985 | Baker et al. | |

(Continued)

*Primary Examiner* — Katherine Mitchell
*Assistant Examiner* — Johnnie A Shablack
(74) *Attorney, Agent, or Firm* — Goodwin & Procter LLP

(57) ABSTRACT

The invention relates to a rescue apparatus to be lowered from buildings and other elevated locations. The invention includes an enclosure defining an interior space configured for receiving an individual, a harness, and one or more cable securements. The enclosure includes a bottom surface, a sidewall having an internal surface and an external surface, and a closure mechanism coupled to the sidewall and configured for at least partially isolating the interior space from a surrounding environment. In another aspect, the invention relates to a rescue apparatus including a harness assembly and a cable attached thereto.

8 Claims, 7 Drawing Sheets

U.S. PATENT DOCUMENTS 4,538,704 A 9/1985 Forrest
4,550,801 A 11/1985 Forrest
4,580,659 A 4/1986 Baker
4,591,021 A 5/1986 Lew et al.
4,593,787 A 6/1986 Lew et al.
4,593,788 A 6/1986 Miller
4,598,793 A 7/1986 Lew et al.
4,625,335 A 12/1986 Vinai
4,629,032 A 12/1986 Armstrong
4,692,953 A * 9/1987 Fetters ..... 5/99.1
4,709,782 A 12/1987 Lipinski
4,717,056 A * 1/1988 Carmichael ..... 224/158
4,781,269 A 11/1988 Clay
4,887,694 A 12/1989 Ho
4,970,739 A * 11/1990 Bradford ..... 5/625
4,973,277 A 11/1990 Khanamirian
5,020,633 A 6/1991 Rangel
5,050,254 A * 9/1991 Murphy ..... 5/625
5,060,758 A * 10/1991 Ishioka ..... 182/234
5,070,962 A * 12/1991 Varner ..... 182/7
5,186,275 A 2/1993 Bajin
5,232,263 A 8/1993 D'Ull et al.
5,243,724 A * 9/1993 Barnes ..... 5/482
5,279,386 A 1/1994 Cearley
5,289,959 A 3/1994 Beeley et al.
5,458,550 A 10/1995 Braim et al.
5,560,491 A 10/1996 Romaniuk et al.
5,678,739 A * 10/1997 Darling et al. ..... 224/160
5,729,850 A * 3/1998 Eskeli ..... 5/621
5,738,046 A 4/1998 Williams et al.
5,787,529 A * 8/1998 Landes ..... 5/628
5,845,741 A 12/1998 Dwyer
5,913,383 A 6/1999 Tseng
6,029,771 A 2/2000 Keown
6,095,613 A 8/2000 Ostrander et al.
6,102,569 A * 8/2000 Wang ..... 383/104
6,247,755 B1 * 6/2001 Canna et al. ..... 297/468
6,256,789 B1 7/2001 Young et al.
6,612,453 B2 * 9/2003 Joo-Tai ..... 220/9.2
6,672,428 B2 1/2004 Gelman et al.
6,820,721 B1 11/2004 Henson
6,830,170 B2 * 12/2004 Abel ..... 224/634
6,845,523 B2 1/2005 Copp
6,880,671 B2 * 4/2005 Raby ..... 182/7
6,892,897 B2 * 5/2005 Stewart ..... 220/252
6,955,244 B2 10/2005 Yerman
6,966,407 B2 11/2005 Karnes et al.
6,968,809 B2 11/2005 Reardon
7,066,647 B2 * 6/2006 Peska ..... 383/40
7,073,866 B1 7/2006 Berdahl
7,131,679 B1 11/2006 Teran
7,168,110 B2 * 1/2007 Girard et al. ..... 5/89.1
7,353,963 B1 * 4/2008 Sabounjian ..... 220/9.4
7,389,897 B2 * 6/2008 Pistiolis et al. ..... 224/158
7,404,219 B2 * 7/2008 Berkey ..... 5/98.1
7,865,986 B2 * 1/2011 Smart ..... 5/625
7,917,969 B2 * 4/2011 Iwasiuk ..... 2/69
7,971,596 B2 * 7/2011 Morris et al. ..... 135/96
8,070,006 B2 * 12/2011 Austin et al. ..... 220/9.2
2003/0000017 A1 * 1/2003 Byerrum et al. ..... 5/625
2003/0057023 A1 * 3/2003 Gartsbeyn et al. ..... 182/192
2003/0106895 A1 * 6/2003 Kalal ..... 220/9.2
2003/0183630 A1 * 10/2003 Schneider et al. ..... 220/9.2
2003/0205430 A1 11/2003 Na
2003/0213645 A1 11/2003 Pine
2004/0155038 A1 * 8/2004 Smith ..... 220/9.2
2004/0267685 A1 12/2004 Sharland et al.
2005/0023081 A1 * 2/2005 Raby ..... 182/7
2005/0039982 A1 2/2005 Jensen
2005/0249439 A1 * 11/2005 Penson ..... 383/38
2005/0284866 A1 * 12/2005 Oakner et al. ..... 220/9.2
2007/0257034 A1 * 11/2007 Sabounjian ..... 220/9.2
2008/0056625 A1 * 3/2008 Stanton et al. ..... 383/104
2008/0131034 A1 * 6/2008 Sulpizio et al. ..... 383/119
2008/0135550 A1 * 6/2008 Williams ..... 220/9.2
2009/0114691 A1 * 5/2009 Bizzell et al. ..... 224/577
2010/0051658 A1 * 3/2010 Parness ..... 224/158
2010/0059514 A1 * 3/2010 Zheng ..... 220/9.2
2010/0096419 A1 * 4/2010 Stephens ..... 224/153
2011/0036664 A1 * 2/2011 Peters et al. ..... 182/70

* cited by examiner

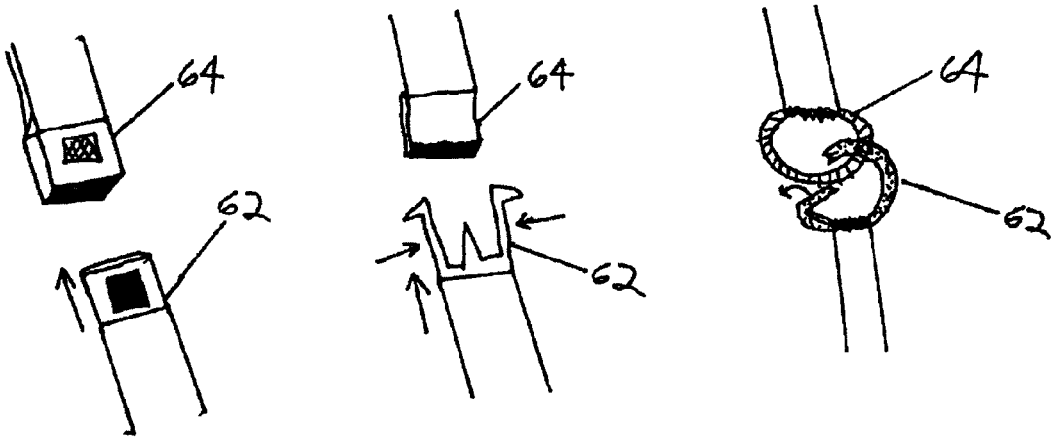
Fig.5a Fig. 5b Fig. 5c
Figure 5
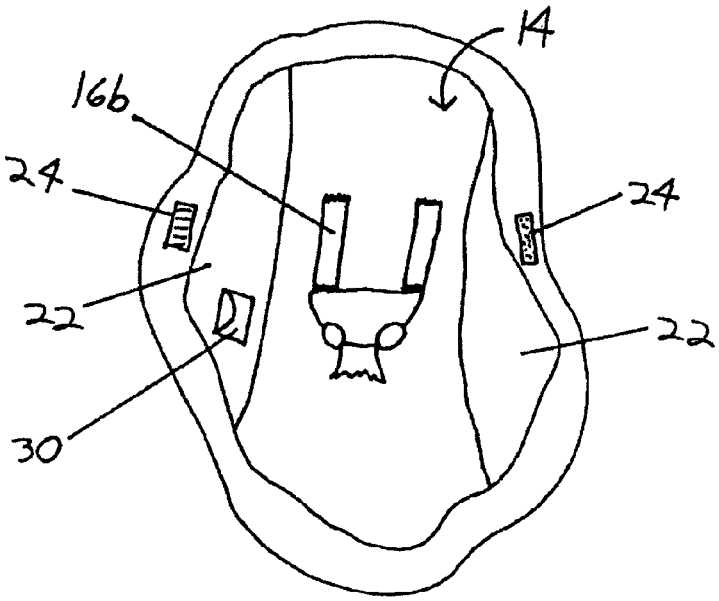
Figure 6

RESCUE APPARATUS

RELATED APPLICATIONS

This application claims priority to U.S. Provisional Patent Application Ser. No. 61/051,089, filed May 7, 2008, the disclosure of which is hereby incorporated by reference in its entirety.

FIELD OF THE INVENTION

This invention relates generally to rescue devices, and more particularly to devices adapted to be lowered from buildings and other elevated locations.

BACKGROUND

Fires and other disasters are an everyday risk for millions of individuals who live or work on elevated floors of buildings. Frequently, children, elderly individuals, pets, and other at-risk groups are unable to reach safety on their own, especially where traditional escape routes, such as stairways, are obstructed. Therefore, several devices have been created to assist individuals exiting a building via windows. Frequently, these devices are anchored to a portion of the building, either inside or outside the window an individual is to be lowered out of, and include a receptacle or sling for receiving the body of an individual. Examples of escape and child safety devices can be found, for example, in U.S. Pat. Nos. 6,880,671, 285, 564, 6,029,771, 6,966,407, 3,871,480, 6,095,613, and 6,672, 428, and U.S. Patent Application Publication No. 2005/0132495, the entire disclosures of which are hereby incorporated by reference herein.

SUMMARY

The present invention is generally directed to a rescue apparatus for lowering children, the elderly, pets, or other at-risk individuals from a first, elevated position to a second, lower position, thus helping them avoid a hazard located near the first position.

In one aspect, the invention relates to a rescue apparatus including an enclosure defining an interior space configured for receiving an individual, a harness, and one or more cable securements. The enclosure includes a bottom surface, a sidewall having an internal surface and an external surface, and a closure mechanism coupled to the sidewall and configured for at least partially isolating the interior space from a surrounding environment.

In various embodiments of this aspect, the enclosure includes a support structure that prevents the sidewall from collapsing. The sidewall may have one or more handles disposed on the external surface thereof, to facilitate moving the apparatus. In an additional embodiment, the one or more cable securements are at least partially disposed on the one or more handles. In another embodiment, the closure mechanism is formed from a drawstring. In one embodiment, the harness includes straps that cross each other over at least a portion of the individual's torso.

Additionally, the enclosure may be formed from a material possessing properties including at least one of heat resistant, water resistant, and breathable. For example, the enclosure may be formed from GORE-TEX® fabric for water resistant qualities, Stomatex® neoprene for breathable qualities, and Nomex® fabric for heat resistant qualities. The enclosure may also include at least one of an internal pocket and an external pocket for containing personal information.

In additional embodiments, the bottom surface of the enclosure includes a substantially rigid member to provide added support to the enclosure. Additionally, a cushioning material may be placed proximate to the bottom surface of the enclosure and the substantially rigid member.

In another aspect, the invention relates to a rescue apparatus including a harness assembly and a cable attached thereto. The harness assembly includes a receptacle for receiving at least a portion of an individual's torso, the receptacle defining at least two openings configured for passing therethrough limbs of an individual. The harness also includes a back support coupled to the receptacle, and a restraint coupled to the receptacle and back support, the restraint configured for securing the individual in the harness assembly.

The harness also includes a loop system secured to an exterior surface of the back support, the loop system substantially centrally located along a length of the back support, a first shoulder loop secured to a top corner of the back support, and a second shoulder loop secured to a top corner of the back support substantially opposite the first shoulder loop. The cable is threaded through the loop system and through the first and second shoulder loops, and is configured for lowering the harness assembly from an elevated position.

In various embodiments of the foregoing aspect, the openings in the receptacle are configured to receive the legs of the individual. In another embodiment, the enclosure may be formed from a material possessing properties including at least one of heat resistant and water resistant. For example, the enclosure may be formed from GORE-TEX® fabric for water resistant qualities and Nomex® fabric for heat resistant qualities. In one embodiment, the harness assembly may also include at least one of an internal pocket and an external pocket for containing personal information. In one embodiment, the restraint includes straps that cross each other over at least a portion of the individual's torso. In another embodiment, the cable is configured to prevent rotation of the harness assemble about a horizontal axis.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which:

FIGS. 5A-5C are schematic perspective views of various closure mechanisms for harnesses and restraints, for use in various embodiments of the invention; and FIG. 6 is a plan view of a rescue apparatus in accordance with one embodiment of the invention.

DETAILED DESCRIPTION

Figure 1A:
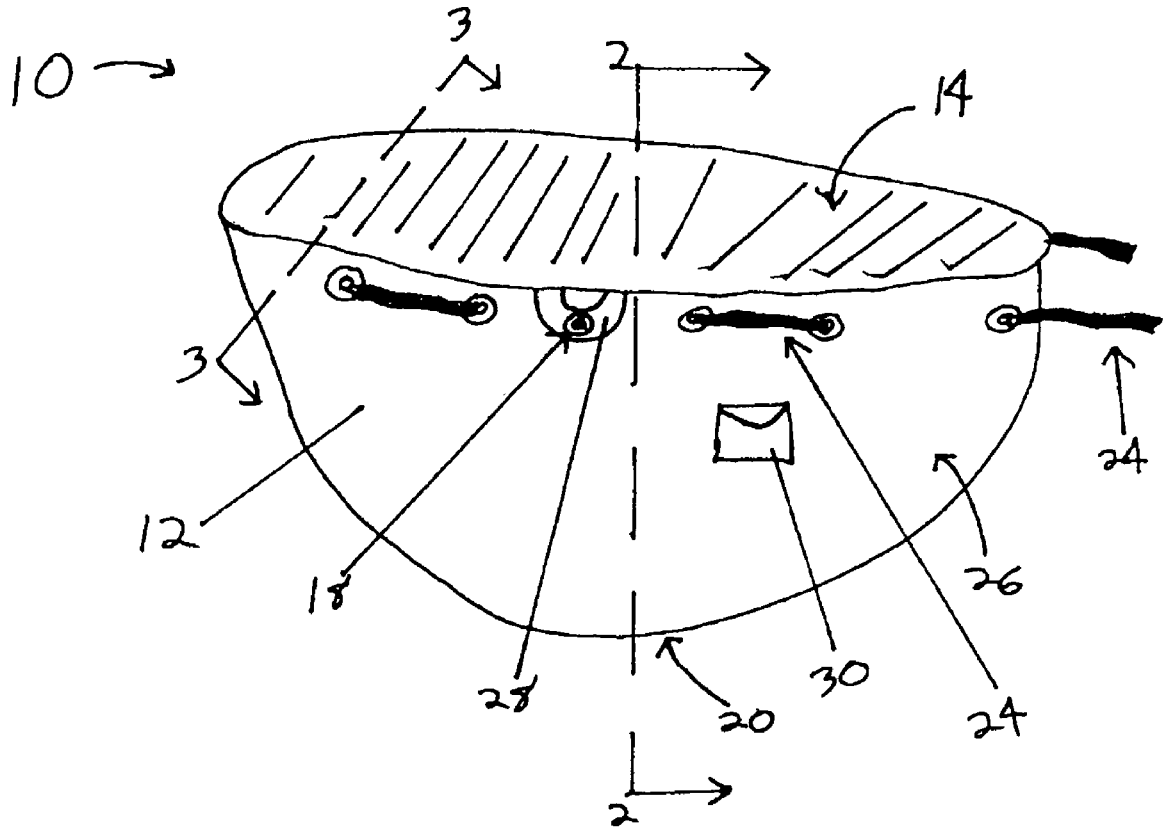
FIG. 1A is a schematic perspective view of a rescue apparatus in accordance with one embodiment of the invention.
Figure 1B:
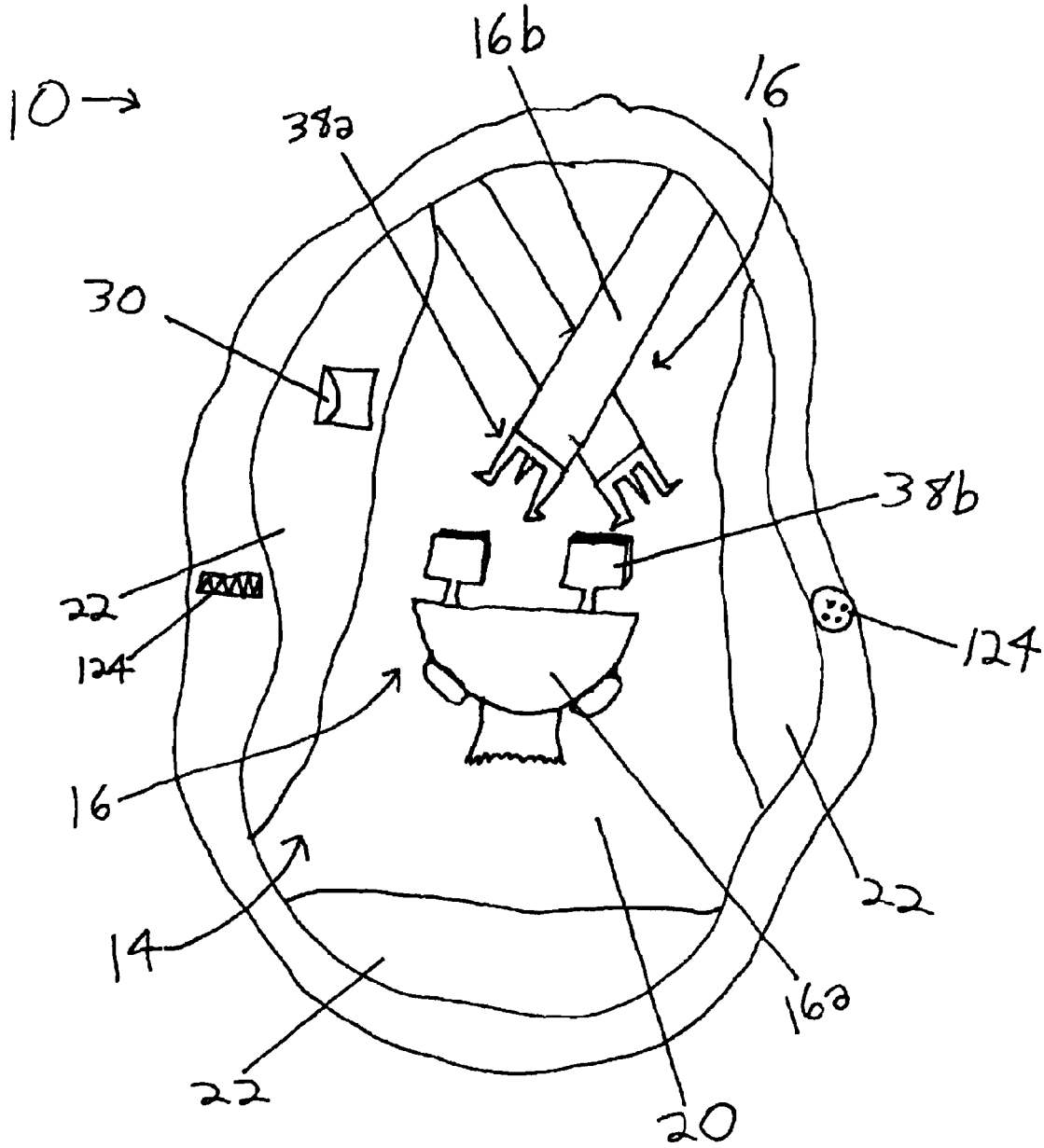
FIG. 1B is a plan view of the apparatus of FIG. 1A.

FIG. 1A is a schematic perspective view of a rescue apparatus 10 in accordance with one embodiment of the invention, and FIG. 1B is a plan view of the apparatus 10 of FIG. 1A. The rescue apparatus 10 includes an enclosure 12 defining an interior space 14, a harness 16, and one or more cable securements 18. The enclosure 12 may be formed from any material suitable for bearing the weight of an individual (not shown) placed in the apparatus 10, and preferably is light enough to be moved with minimal effort. The interior space 14 includes a bottom surface 20, a sidewall 22, and a closure mechanism 24 configured for at least partially isolating the interior space 14 from a surrounding environment. In one embodiment, the interior space 14 is substantially oblong, and the sidewall 22 may be continuous. In other embodiments, the interior space 14 is polygonal, and the sidewall 22 is composed of substantially planar panels. The harness 16 is disposed within the interior space 14 and is configured for securing an individual, for example, a human or a pet, within the enclosure 12. The harness 16 includes a body receiving portion 16*a* and limb receiving portions 16*b*.

In one embodiment, an external surface 26 of the sidewall 22 includes one or more handles 28 for carrying the apparatus 10, and the enclosure 12 includes one or more pockets 30. In another embodiment, the one or more cable securements 18 are at least partially disposed on the one or more handles 28, as illustrated in FIG. 1A. The enclosure 12 may be formed from a material which is heat resistant, water resistant, and/or breathable. In an exemplary embodiment, the enclosure 12 is formed from a material which possesses two or more of these characteristics.

When the apparatus 10 is used, the individual is placed within the interior space 14 of the enclosure 12 and secured in the harness 16. A cable (not shown) is then attached to the one or more cable securements 18, if the cable is not already connected, and the cable is used to lower the apparatus 10 to a point of safety. The cable may be formed from any material strong enough to support the weight of the individual, and may be composed of, for example, a natural fiber, an artificial fiber, or a metal, which may be braided or unbraided, or any combination thereof. Before the apparatus 10 is lowered, the closure mechanism 24 can be operated, and personal information such as, for example, medical information, is placed within a pocket 30. If present, the one or more handles 28 may be used to move the apparatus 10 to a point from which the apparatus 10 may be lowered or, once lowered, away from a point of danger.

Figure 2:
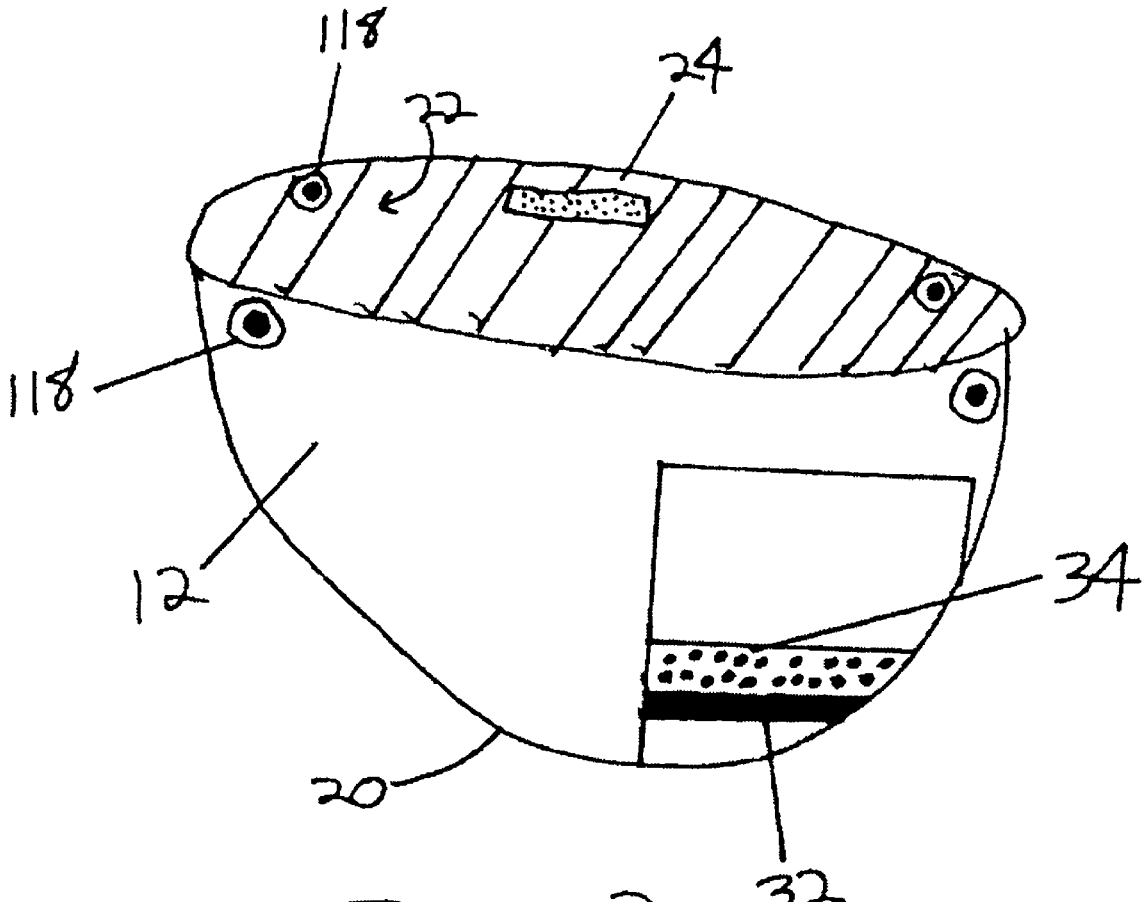
FIG. 2 is a schematic, partial cross-sectional view of one embodiment of the rescue apparatus of FIG. 1A taken at line 2-2.

FIG. 2 is a schematic, partial cross-sectional view of the rescue apparatus 10 of FIG. 1A taken at line 2-2. As shown, in one embodiment, the bottom surface 20 of the enclosure 12 includes a substantially rigid member 32. The substantially rigid member 32 provides additional structure to the bottom surface 20, and provides additional support and comfort to the occupant of the interior space 14. The substantially rigid member 32 may be composed of any material able to withstand the weight of the individual placed upon it, and may be, for example, a metal, a plastic, a composite, or a combination thereof. In one embodiment, the substantially rigid member 32 is formed such that its shape is substantially contoured to the individual's body. Additionally, the substantially rigid member 32 may be formed from a material that is heat resistant and/or water resistant. In one embodiment, a cushioning material 34 is located proximate to the bottom surface 20 and the substantially rigid member 32. The cushioning material 34 provides additional comfort to the occupant of the enclosure 12, and may be composed of any material able to accomplish this goal, such as, for example, a polyurethane foam. Additionally, the cushioning material 34 may be formed from a material which is heat resistant and/or water resistant.

Figure 3:
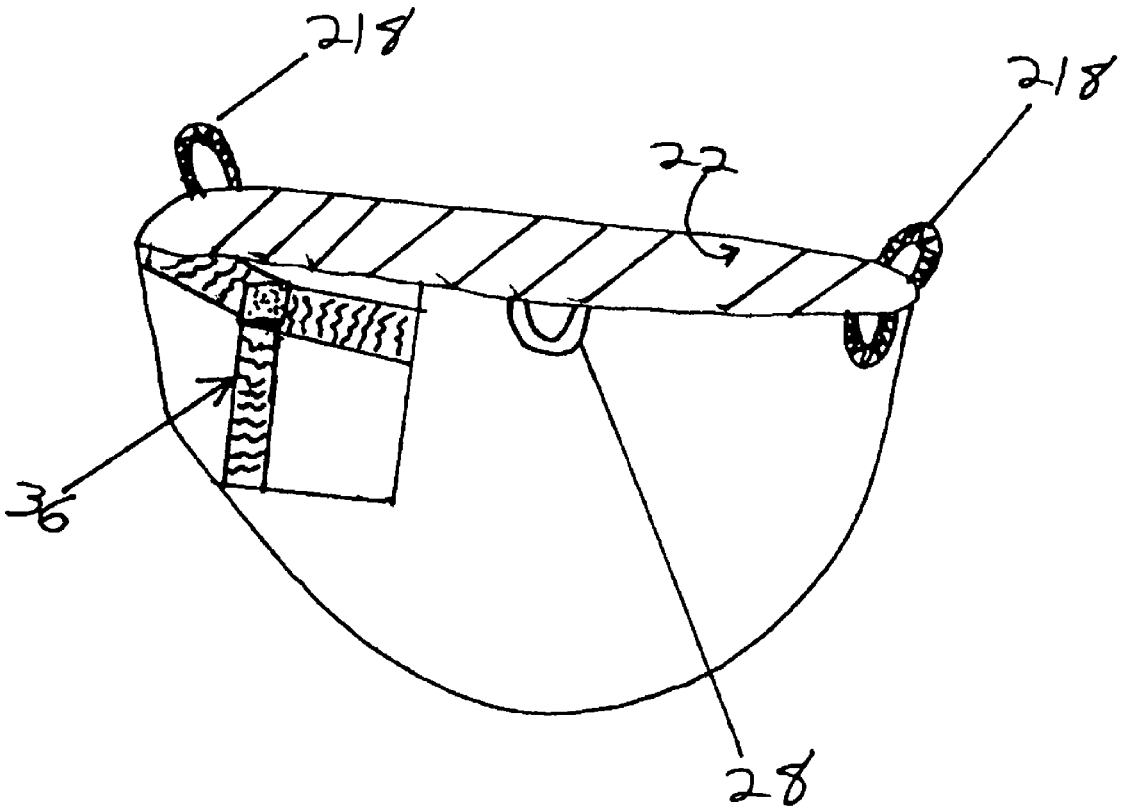
FIG. 3 is a schematic, partial cross-sectional view of one embodiment of the rescue apparatus of FIG. 1A taken at line 3-3.

FIG. 3 is a schematic, partial cross-sectional view of one embodiment of the rescue apparatus 10 of FIG. 1A taken at line 3-3. The enclosure 12 may include a support structure 36 to prevent the sidewall 22 from inwardly collapsing. The support structure 36 may be disposed within the sidewall 22 or substantially adjacent thereto, and may be formed from, for example, support panels or substantially linear support members. The one or more support panels or support members may attach to one or more joints, such that a predetermined structural shape is attained. In one embodiment, the support structure 36 is collapsible, such that the rescue apparatus 10 becomes substantially flat when not in use. The support structure 36 may be collapsed, for example, when a locking mechanism that keeps the support structure 36 in an erect configuration is released. In another embodiment, the support structure 36 is formed from a flexible material that contains lower potential energy when in an erect configuration. The support structure 36 and the apparatus 10 may be collapsed by applying force to the support structure 36, which increases the potential energy of the support structure 36. The apparatus 10 may then be secured in this configuration, until it is needed. When needed, the apparatus 10 is unsecured, and the potential energy of the flexible material forming the support structure 36 is released, urging the support structure 36 and the apparatus 10 into an erect configuration.

In one embodiment of the invention, the closure mechanism 24 is a drawstring, yet, in alternate embodiments, the closure mechanism 24 may be a zipper, a button, a hook-and-loop type fastener, or any other feature suitable for at least partially isolating the interior space 14 from the outside environment. For example, FIG. 1B illustrates an embodiment utilizing a button 124 to least partially isolate the interior space 14 from the outside environment.

The one or more cable securements 18 may be configured in several manners. In addition to being disposed on the handles 28, cable securements 18 may be located on any portion of the enclosure 12. Any feature capable of supporting the apparatus under the weight of an individual located within the interior space 14 may be used. The cable securement 18 may be, for example, one or more grommets 118 (FIG. 2) disposed proximate to the upper portion of the sidewall 22, and may be configured to maximize balance of apparatus 10 when in use. In another embodiment, the cable securement 18 may be, for example, one or more loops 218, as shown in FIG. 3.

In various embodiments, the harness 16 may be configured in several manners. For example, in one embodiment, both ends of the limb receiving portions 16*b* are permanently attached to the interior space 14, as shown in FIG. 6, via, for example, stitching. In another embodiment, one end of the limb receiving portions 16*b* may be permanently attached to the interior space 14, while another end includes a removable securement means 38*a*, which mates to a receiving portion 38*b* located within the interior space 14. In one embodiment, the receiving portion 38*b* is located on the body receiving portion 16*a*. The removable securement means 38*a* may be of any type, and may be, for example, a buckle, a snap or a carabiner, as shown in FIG. 5. Preferably, the removable securement means 38*a* is of a type which is easy to operate, but which is configured to prevent accidental release. Additionally, the limb receiving portions 16*b* may be configured such that they run parallel to one another, as shown in FIG. 6, or they may cross each other over at least a portion of the individual's torso, as shown in FIG. 1B.

Figure 4A:
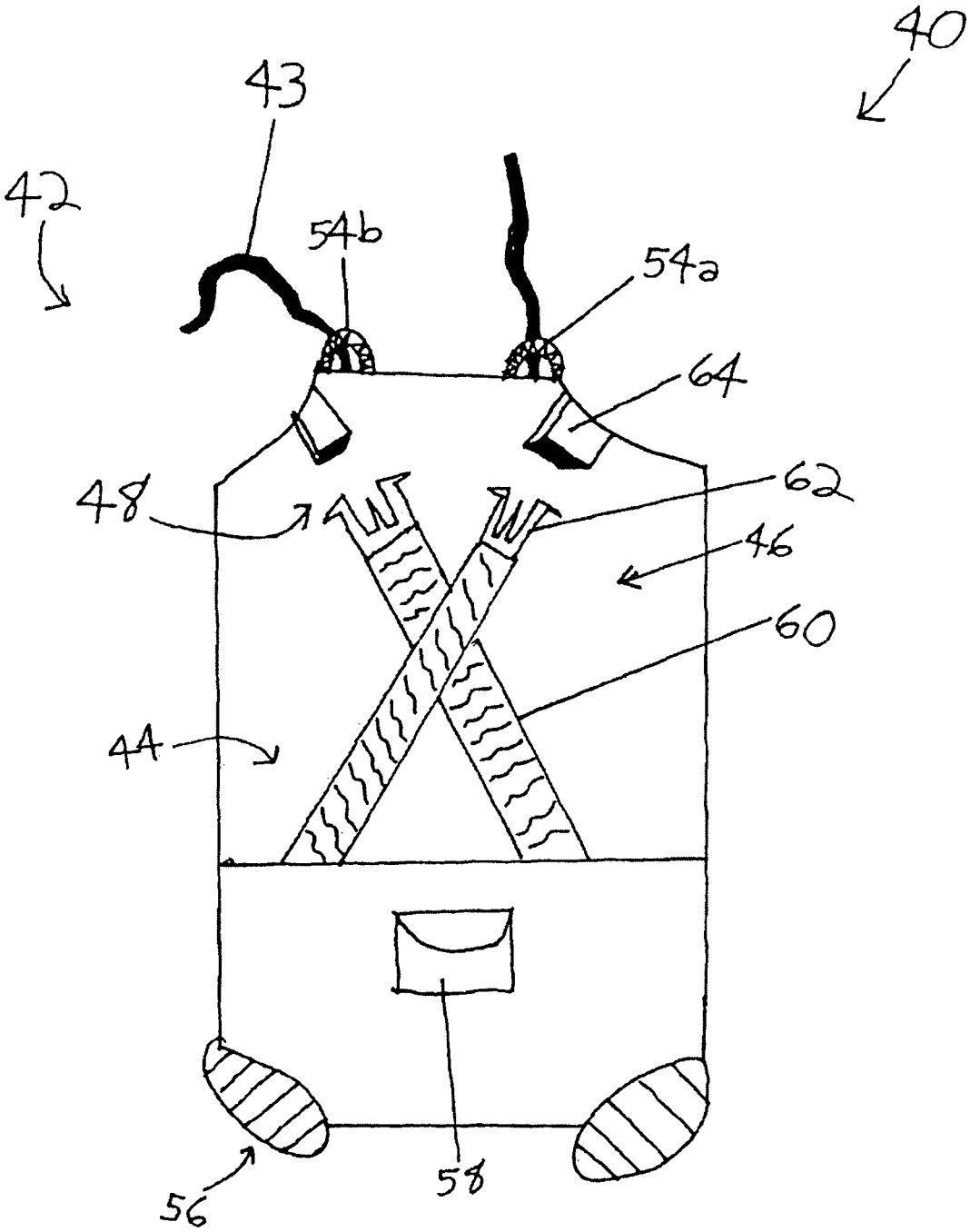
FIGS. 4A and 4B are front and rear views, respectively, of a rescue apparatus in accordance with one embodiment of the invention.
Figure 4B:
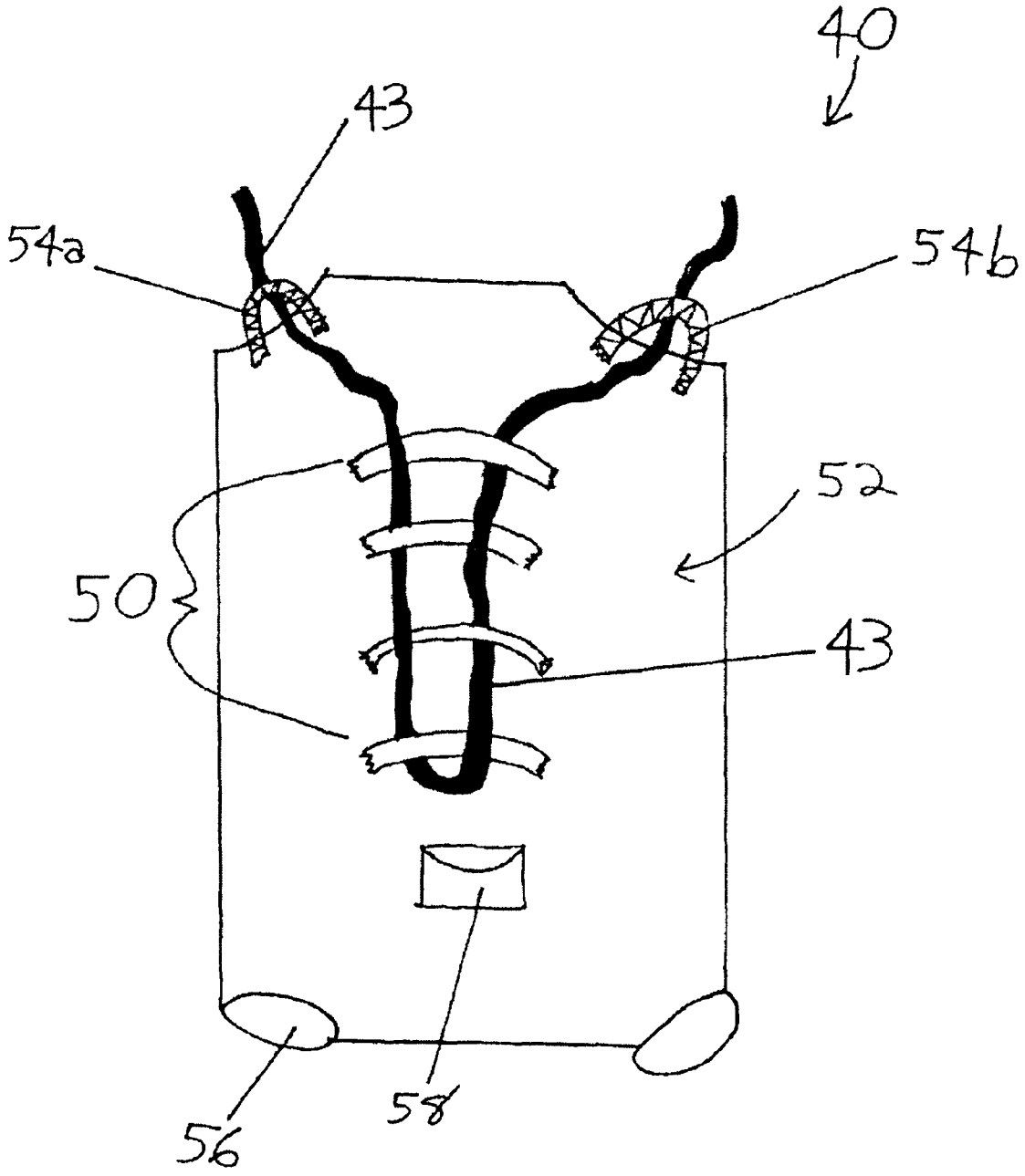

FIGS. 4A and 4B are front and rear views, respectively, of a rescue apparatus 40 in accordance with one embodiment of the invention. The rescue apparatus 40 includes a harness assembly 42 and a cable 43. The harness assembly 42 includes a receptacle 44 for receiving at least a portion of an individual's torso (not shown), a back support 46 coupled to the receptacle 44, a restraint 48 coupled to the receptacle 44 and back support 46, a loop system 50 secured to an exterior surface 52 of the back support 46, a first shoulder loop 54*a* secured to a top corner of the back support 46, and a second shoulder loop 54*b* secured to a top corner of the back support 46 opposite the first shoulder loop 54*a*. The receptacle 44 defines at least two openings 56 configured for passing therethrough limbs of an individual, and the restraint 48 is configured for securing the individual in the harness assembly 42. The harness assembly 42 may also include one or more pockets 58. Additionally, the openings 56 may be configured for passing therethrough the individual's legs.

The loop system 50 is substantially centrally located along a length of the back support 46, and the cable 43 is passed through the loop system 50 and through the first shoulder loop 54*a* and second shoulder loop 54*b*, where the cable 43 is thereby configured for lowering the harness assembly 42 from an elevated position. The cable 43 may be passed through the loop system 50 in several manners. For example, in one embodiment, the cable 43 passes through all of the loops in the loop system 50, while in another embodiment, the cable 43 passes through alternating loops. Additionally, the cable may be secured to one or more of the loops in the loop system 50, the first shoulder loop 54*a*, and/or the second shoulder loop 54*b*, via, for example, a knot, or any of the methods shown in FIG. 5. In one embodiment, the cable 43 is configured to minimize rotation of the harness assembly 42 about a horizontal axis.

The harness assembly 42 can be formed from a material which is heat resistant or water resistant. In an exemplary embodiment, the harness assembly 42 is formed from a material which possesses both of these characteristics.

FIG. 4A shows a restraint 48 according to one embodiment of the invention. Restraint 48 is composed of one or more limb receiving portions 60, which may or may not have both ends thereof permanently attached to the harness assembly 42. Where only one end of the limb receiving portion 60 is permanently attached, the opposite end includes a removable securement means 62 at its terminus, which releasably engages with a receiving portion 64. In one embodiment, receiving portion 64 and securement means 62 engage at a location proximate to the upper portion of the harness assembly 42, while in other embodiments, receiving portion 64 and securement means 62 engage at another location, such as, for example, proximate to the lower portion of the receptacle 44. Receiving portion 64 and securement means 62 may be of any type, and may be, for example, a buckle, a snap or a carabiner, as shown in FIG. 5. Preferably, securement means 62 is of a type which is easy to operate, but is configured to prevent accidental release. In one embodiment, the limb receiving portions 60 are configured such that they cross each other over at least a portion of the individual's torso, as illustrated in FIG. 4A.

In addition to the materials described above, the apparatus 10 may be formed from a material or fabric, such as, for example, a canvas, a woven plastic material, or a combination thereof, which is preferably resistant to wear caused by friction. These materials may be coated to provide them with resistance to heat and/or water. The rescue apparatus 10 may be manufactured by any process commonly utilized in forming luggage or rescue devices, such as, for example, stitching, radio frequency (RF) welding, or a combination thereof.

Having described certain embodiments of the invention, it will be apparent to those of ordinary skill in the art that other embodiments incorporating the concepts disclosed herein may be used without departing from the spirit and the scope of the inventions. The described embodiments are to be considered in all respects as only illustrative and not restrictive.

What is claimed is:

1. A rescue apparatus comprising:

a substantially oblong enclosure defining an interior space configured for receiving an individual, the enclosure comprising:

a substantially convex bottom surface;

a continuous sidewall having an internal surface and an external surface, the external surface having one or more handles attached thereto;

a closure mechanism coupled to the sidewall and configured for at least partially isolating the interior space from a surrounding environment;

a substantially rigid member disposed within the interior space and proximate the bottom surface of the enclosure, the member adapted to support the individual within the enclosure and positioned to define a space between the substantially convex bottom surface of the enclosure and a bottom surface of the member such that that bottom surface of the member is not in direct contact with the bottom surface of the enclosure;

a cushioning material disposed within the interior space and in direct contact with the substantially rigid member;

a collapsible support structure adapted to prevent the sidewall from collapsing inwardly, wherein the support structure is formed from a substantially flexible material and adapted to urge the enclosure into an erect configuration;

a harness disposed within the interior space of the enclosure and configured for securing the individual within the enclosure; and one or more cable securements attached to the enclosure and configured to receive a cable for lowering the enclosure from a building egress, wherein at least one of the cable securements is disposed on the one or more handles and comprises an opening therethrough.

2. The apparatus of claim 1, wherein the enclosure is formed from a material possessing properties selected from the group consisting of heat resistance, water resistance, and breathability.

3. The apparatus of claim 1, wherein the closure mechanism comprises a drawstring.

4. The apparatus of claim 1, wherein the enclosure includes at least one of an internal pocket and an external pocket.

5. The apparatus of claim 1, wherein the harness includes straps which cross over at least a portion of the individual's torso.

6. The apparatus of claim 1, wherein the support structure is disposed within the sidewall.

7. The apparatus of claim 1, wherein the support structure is disposed substantially adjacent to the sidewall.

8. The apparatus of claim 1, wherein the harness comprises a body receiving portion and a plurality of limb receiving portions, each limb receiving portion comprising a single-piece strap having both ends permanently attached to the interior space.

* * * * *